US005147215A

United States Patent [19]

Pritulsky

[11] Patent Number: 5,147,215

[45] Date of Patent: Sep. 15, 1992

[54] CONNECTOR WITH INTEGRAL WIRE MANAGEMENT SYSTEM

[75] Inventor: James Pritulsky, Hummelstown, Pa.

[73] Assignee: AMP Incorporated, Harrisburg, Pa.

[21] Appl. No.: 739,781

[22] Filed: Jul. 31, 1991

Related U.S. Application Data

[63] Continuation of Ser. No. 490,178, Mar. 8, 1990, abandoned.

[51] Int. Cl.[5] ..... H01R 4/50

[52] U.S. Cl. ..... 439/344; 439/404; 439/406; 439/676

[58] Field of Search ..... 439/676, 344, 404, 405, 439/406, 395, 391, 394, 668, 407

[56] References Cited

U.S. PATENT DOCUMENTS

| | | | |
|---|---|---|---|
| 4,601,530 | 7/1986 | Coldren et al. | 339/103 M |
| 4,607,905 | 8/1986 | Vaden | 439/676 |
| 4,618,202 | 10/1986 | Libregts et al. | 339/99 R |
| 4,713,023 | 12/1987 | Bixler et al. | 439/393 |
| 4,767,355 | 8/1988 | Phillipson et al. | 439/425 |

*Primary Examiner*—Larry I. Schwartz

*Assistant Examiner*—J. R. Daulton

*Attorney, Agent, or Firm*—David L. Smith

[57] ABSTRACT

An electrical conductor has a dielectric housing having an elongate cable receiving cavity opening onto a rear surface thereof. The cavity extends away from the rear surface blind ending at a wall. The cavity defines a major axis between the rear surface and the wall. The cavity also defines a bottom wall extending from the rear surface to the wall. The bottom wall has rib means thereon extending into the cavity and extending from the rear face substantially to the wall means. Insulation piercing contacts are secured in contact receiving passages that extend transverse to the axis and intersect the cable receiving cavity. The passages intersect the cavity at the bottom wall proximate where the cavity blind ends. The insulation piercing contacts have a mating surface and an insulation piercing surface and are adapted to be pressed toward the cavity subsequent to insertion of insulated conductors therein. The conductors are adapted to be received axially along the cavity to engage the blind end wall to position the conductors for termination.

2 Claims, 6 Drawing Sheets

CONNECTOR WITH INTEGRAL WIRE MANAGEMENT SYSTEM

This application is a continuation of application Ser. No. 07/490,178 filed Mar. 8, 1990, now abandoned.

BACKGROUND OF THE INVENTION

This invention relates to prepositioning wires in an electrical connector for termination and in particular to an electrical connector having an integral wire management system.

When the insulative jacket of a multiple conductor cable is removed in preparing for terminating conductors of the cable in a connector, a bundle of discrete insulated conductors are unveiled. Discrete conductors are not maintained in the desired spaced lateral positions at a predetermined pitch appropriate for insertion into a connector for termination therein. Due in large part to conductors of a round cable being formed in a helical spiral, certain characteristics of which are retained after removal of the insulative jacket, conductors of a cable do not lay flat after having been part of a cable. Prior art connectors employed a wire holder, capable of being slidably received in a passageway, to receive the conductors and maintain the conductors in the desired spaced lateral positions for termination in the connector. Alternatively, conductors were taped to be maintained in a predetermined lateral spacing or the conductors were positioned with the conductors in the cavity and the cable repeatedly moved toward and away from the connector until the conductors were received in the connector for termination.

There is disclosed in U.S. Pat. No. 4,601,530 a connector and wire holder wherein the wire holder is adapted to be received in a connector cavity. The wire holder is adapted to receive discrete wires in a series of staggered wire locating apertures having the same centerline spacing as the pitch of the insulation piercing contacts in the connector. The apertures open to a common side of the wire holder providing conductor receiving openings through which the conductors are received transverse to the axis thereof. The wire holder is sized to be received in a cavity in the connector and slides therein until it abuts a tapering throat. Further advancement of the cable feeds the discrete wires through the wire holder thence into respective blind ended wire receiving passages. When the wires engage the ends of the blind ended passageways, they are positioned for subsequent termination to the contacts.

U.S. Pat. No. 4,767,355 discloses a similar wire holder structure in a load block that receives in respective parallel bores therein the exposed ends of insulated conductors of a cable. The load block serves to facilitate positioning the conductors in the conductor-receiving position of the cord receiving cavity. The load block has a substantially rectangular outer configuration adapted to be snugly received in the plug cavity. When the load block is in its forward-most position, each bore and thus each conductor therein precisely aligns with one of the terminal receiving slots. With the conductors so held in position, terminals are inserted into the slots whereupon tangs on each terminal pierce through the material of each load block and then through a respective conductor to effect electrical engagement therewith.

U.S. Pat. No. 4,713,023 discloses a wire positioning member capable of accommodating different numbers of conductors within the same size housing by maintaining the same exterior dimension while varying the distance between facing interior surfaces of sidewalls between which conductors are received. After the cable conductors are positioned within a wire positioning member, the conductors are cut off a predetermined distance forward from the front edge of the wire positioning member. The wire positioning member is then inserted into a wire receiving opening and the conductors terminated.

While the wire holder simplifies the assembly of a connector during termination of a cable to the connector, the wire holder concomitantly increases the number of parts and hence the cost of the unassembled connector.

SUMMARY OF THE INVENTION

In accordance with the present invention, an electrical connector has a dielectric housing having an elongate cable receiving cavity opening onto a rear surface thereof. The cavity extends away from the rear surface blind ending at a wall. The cavity defines a major axis between the rear surface and the wall. The cavity also defines a bottom wall extending from the rear surface to the wall. The bottom wall has rib means thereon extending into the cavity and extending from the rear face substantially to the wall means. Insulation piercing contacts are secured in contact receiving passages that extend transverse to the axis and intersect the cable receiving cavity. The passages intersect the cavity at the bottom wall proximate where the cavity blind ends. The insulation piercing contacts have a mating surface and an insulation piercing surface and are adapted to be pressed toward the cavity subsequent to insertion of insulated conductors therein. The conductors are adapted to be received axially along the cavity to engage the blind end wall to position the conductors for termination.

DESCRIPTION OF THE PREFERRED EMBODIMENT

Figures 1, 2:
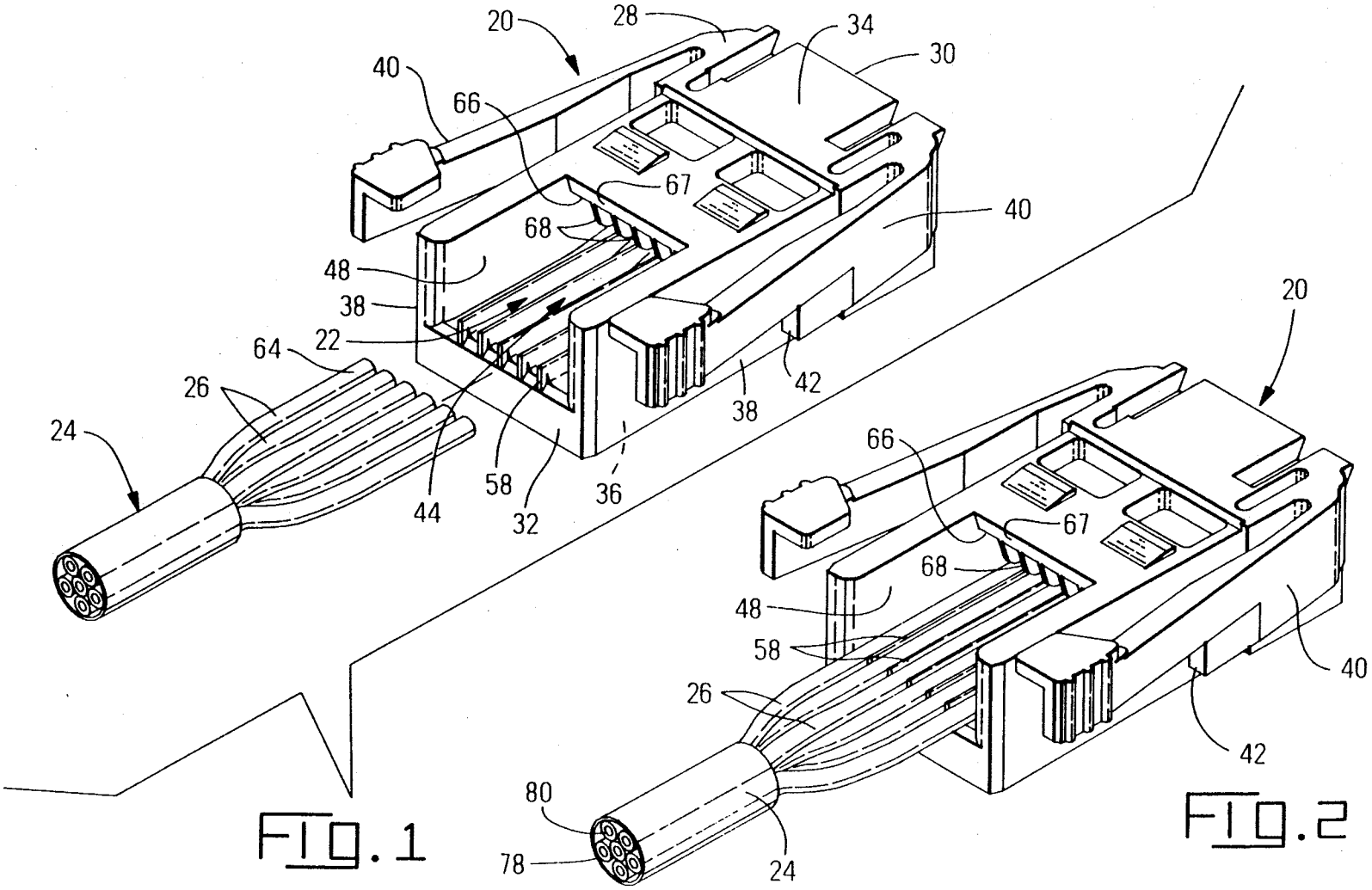
FIG. 1 is a perspective view of a connector in accordance with the present invention with a cable having conductors positioned to be received therein.
FIG. 2 is a perspective view of the connector of FIG. 1 with the cable received therein and terminated thereto.

A connector 20 having an integral wire management system 22 in accordance with the present invention is shown in FIG. 1 with a cable 24 spaced therefrom having insulated conductors 26 positioned to be received in the wire management system 22. Connector 20 has many features in accordance with the teaching of U.S. Pat. No. 3,860,316, the disclosure of which is hereby incorporated by reference. Connector 20 has an insulative housing 28, having a mating end 30, a rearward end 32, upper and lower housing sidewalls 34,36 and oppositely facing housing end walls 38. Latch arms 40 extend from housing end walls 38 and have rearwardly facing shoulders 42 which engage complementary shoulders in a receptacle connector when connector 20 is mated with a receptacle connector such as taught by U.S. Pat. No. 4,221,458, the disclosure of which is hereby incorporated by reference. While connector 20 in the preferred embodiment is shown as an unshielded connector, utilizing the wire managment system 22 in a shielded connector is contemplated within the scope of the invention.

Figure 3:
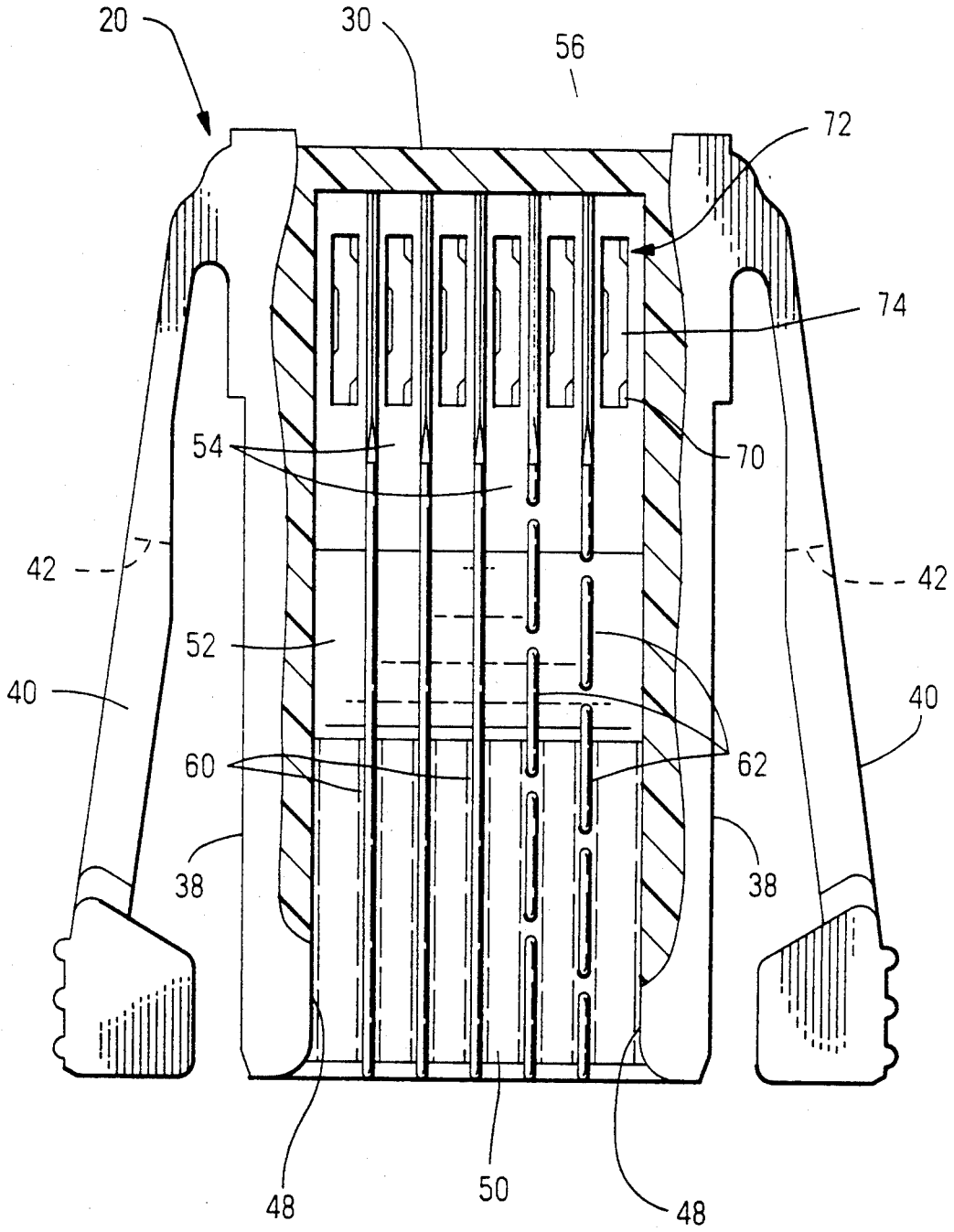
FIG. 3 is a plan view, partially cut away, of the connector of FIG. 1.

A conductor receiving opening 44 formed in rearward end 32 opens into conductor receiving cavity 46. Cavity 46 defines an axis between rear surface 32 and inner surface 56. Rear surface 32 is transverse to the axis through cavity 46. The rearward portion of cavity 46 is defined by the inner surface 48 of end walls 38 and bottom surface 50. Conductor receiving cavity 46 extends forward through a tapering section 52, then extends to form blind end passageways 54 terminating at the inner surface 56 of mating end 30. Cavity 46 is elongate from rearward end 32 to surface 56 and defines a major axis therebetween. Bottom surface 50 has rib means 58 thereon extending from rearward end 32 toward inner surface 56 at least through the open-top portion of cavity 46. Rib means 58 in a preferred embodiment extend substantially from rearward end 32 to inner surface 56. Rib means 58 extend upwardly from bottom surface 50 into cavity 46 to provide an integral wire management system 22 for guiding insulated conductors from the region of rearward end 32 forwardly to inner surface 56. Rib means 58 may be continuous as shown (in FIG. 3) at 60 or intermittent as shown at 62.

Figure 4:
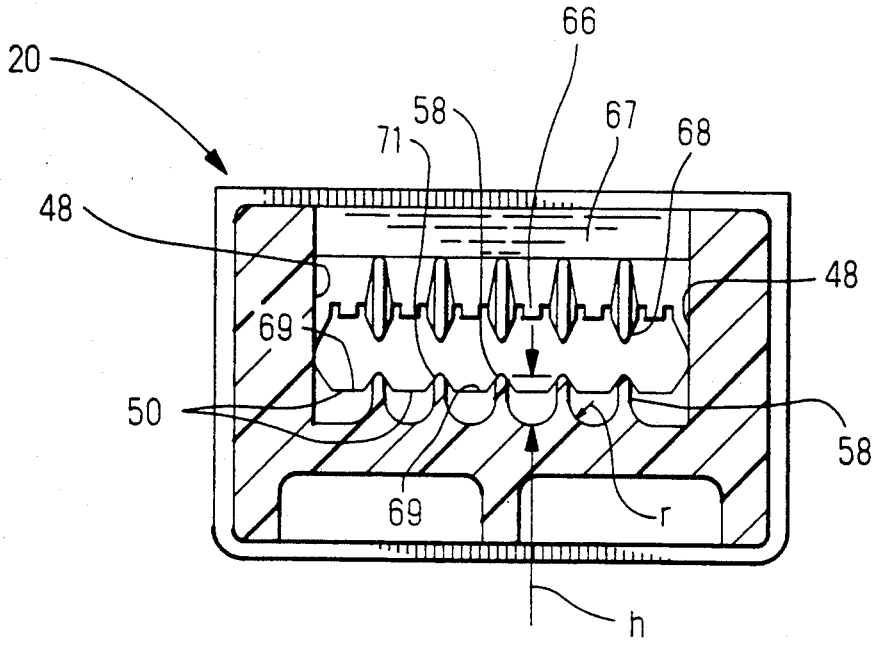
FIG. 4 is a rear sectional view of the connector of FIG. 1.

As best seen in FIG. 4, in a preferred embodiment, the height, h, of a rib means is substantially equal to the diameter of the insulation surrounding a conductor received in the cavity. The height of a rib means could be lower, such as the radius of the insulation, and still function adequately. The radius of the curved lower portion of a channel 69 is slightly larger, in the preferred embodiment, than the outer radius of the insulation surrounding a conductor that will be received therein. To facilitate insertion conductors in channels 69, rib means 58 are narrower near the uppermost edge 71, resulting in a channel that widens near the top.

Figure 4A:
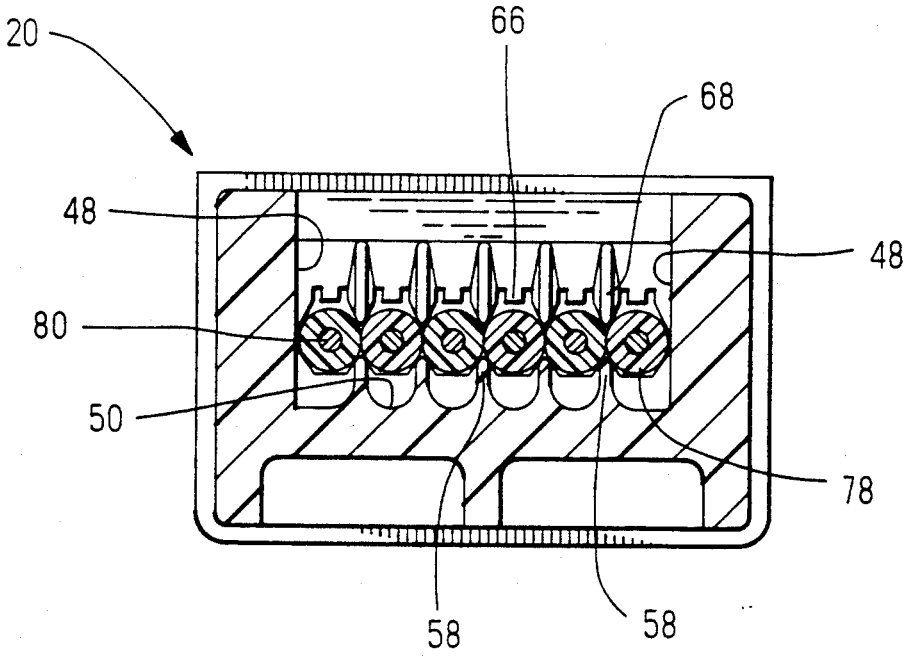
FIG. 4A is the view of FIG. 4 showing conductors received in the cavity.

The conductors in FIG. 4A may appear to be above bottom surface 50, but only appear that way due to the way the conductors are cross sectioned deeper in cavity 46 than the cross section of the housing. Conductors 26 are held in position by rib means 58 and ribs 68 for termination.

Conductor receiving channels 69 are defined between adjacent rib means 58, as well as between an inner surface 48 and the adjacent rib means 58. In the preferred embodiment, adjacent rib means 58 are substantially parallel.

Figure 5:
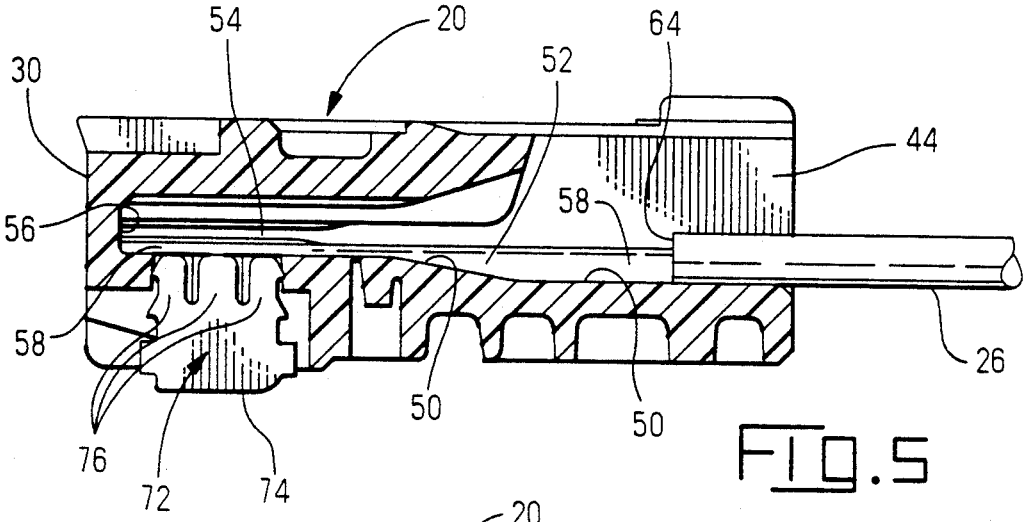
FIG. 5 is a side sectional view of the connector of FIG. 1 with the conductors of the cable received near the rear face.
Figure 6:
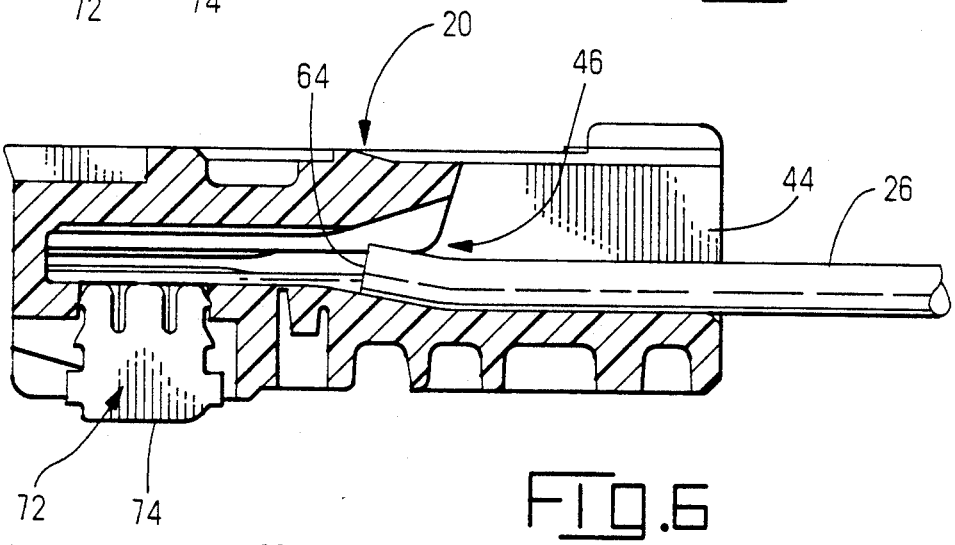
FIG. 6 is a side sectional view of the connector of FIG. 5 with the conductors advanced toward the final position.
Figure 7:
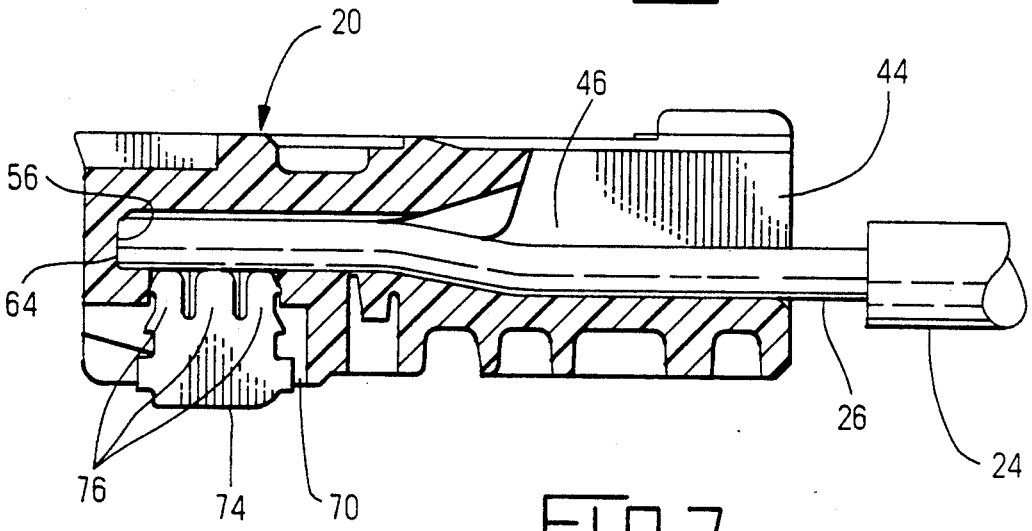
FIG. 7 is a side sectional view with the conductors and cable fully inserted in the termination position.
Figure 8:
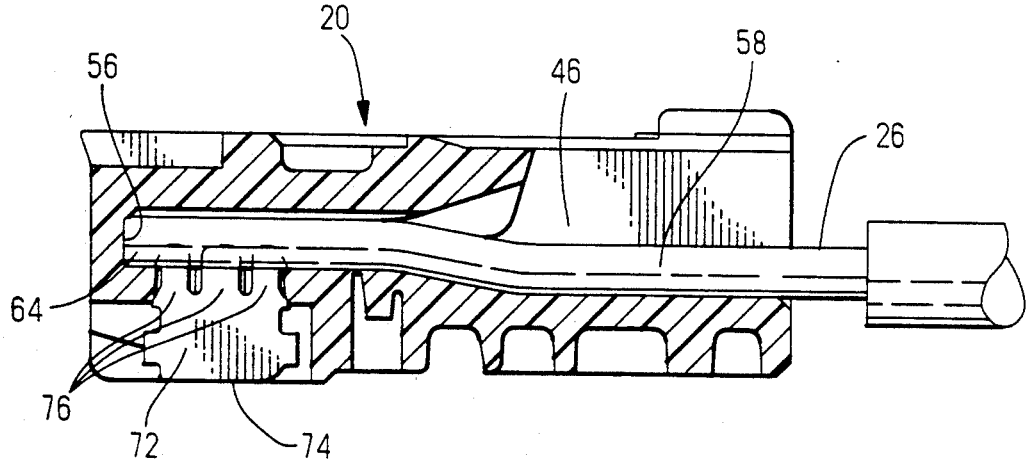
FIG. 8 is a side sectional view with the terminals pressed into the passages to terminate the conductors of the cable.

Rib means 58 extend upwardly from bottom surface 50, as shown in FIG. 4, to a height sufficient to cooperate with insulated conductors 26. Rib means 58 may vary in height from bottom surface 50, which may not be planar, and the height of rib means 50 may depend on the topology of bottom surface 50. Rib means 58 are spaced substantially to assist in maintaining insulated conductors 26 in the desired lateral position and at the correct pitch as the ends 64 of insulated conductors 26 are moved or slid from proximate rearward end 32 into cavity 46 to engage surface 56, as shown in the sequence of FIGS. 5–7. Adjacent rib means 58 may, but need not be parallel to each other. Thus, the spacing of rib means 58 at rearward end 32 may differ from the spacing of rib means 58 near surface 56, the spacing at rearward end 32 being convenient for receiving conductors, with a transition spacing region to the spacing near surface 56 that being the proper spacing for termination.

As seen in FIG. 4, top wall 66 of cavity 46 may also have ribs 68 thereon to enhance cooperation with insulated conductors 26 to maintain insulated conductors 26 in the desired lateral position and at the correct pitch for termination.

Cavity 46 has an open top between rear surface 67 of top wall 66 and rearward end 32. This permits direct access to channels 69 to insert conductors 26. With conductors 26 received in channels 69, cable 24 is pushed toward connector 20 resulting in conductors 26 sliding in channels 69 until the ends thereof abut inner surface 56, thereby positioning conductors 26 in cavity 46 for termination.

The size and spacing of rib means 58 and ribs 68 are such as to position insulated conductors 26 relative to passages 70 and contacts 72 for insulation piercing termination. The outer insulated conductors 26 are guided by and maintained in position, in part, by inner surfaces 48.

Contact receiving passages 70 extend transverse to the major axis and intersect elongate conductor receiving cavity 46 at bottom surface 50 near inner surface 56. Each passage 70 has an insulation displacement contact 72 received and secured therein. Each contact 72 has a mating surface 74 facing away from cavity 46 and an insulation displacement portion 76 facing toward cavity 46.

Contacts 72 are secured partially inserted into passage 70 and are adapted to be pressed toward cavity 46, further into passage 70, subsequent to insertion of insulated conductors 26 into cavity 46 for termination. With conductors 26 received in cavity 46 positioned with the ends 64 engaging surface 56, contacts 72 may be pressed farther into passages 70 such that the insulation displacement portion 76 pierces through the insulation 78 and engages and terminates to a respective conductor 80 in accordance with the teaching of U.S. Pat. No. 4,601,530, the disclosure of which is hereby incorporated by reference.

Since outer insulated conductors 26 are guided by and maintained in position, in part, by inner surface 48, there is typically one less rib means 58 than the number of contacts 72.

Figure 9:
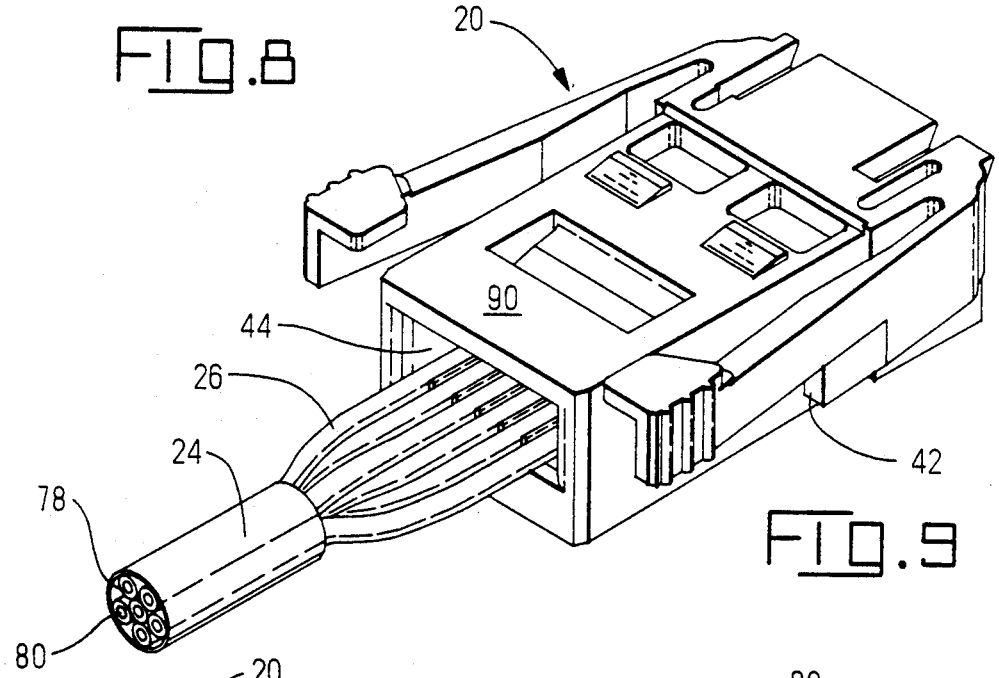
FIG. 9 is a perspective view of an alternate embodiment connector having a strain relief.
Figure 10:
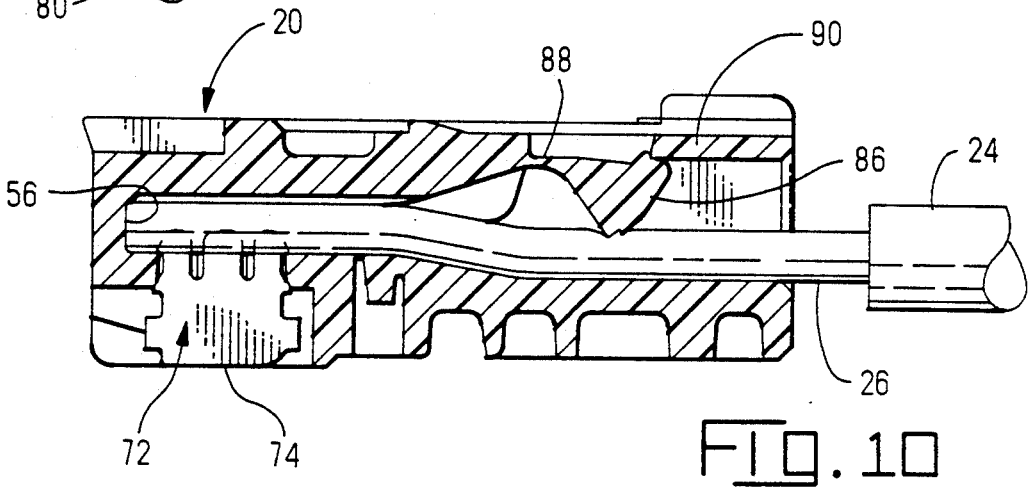
FIG. 10 is a side sectional view of the alternate embodiment connector shown in FIG. 9.

An alternate embodiment connector is shown in FIGS. 9 and 10 wherein a strain relief 86 is shown. Strain relief 86 pivots at 88 to lock under bridging member 90 extending between surfaces 48 adjacent to rearward end 32.

Figures 11, 12:
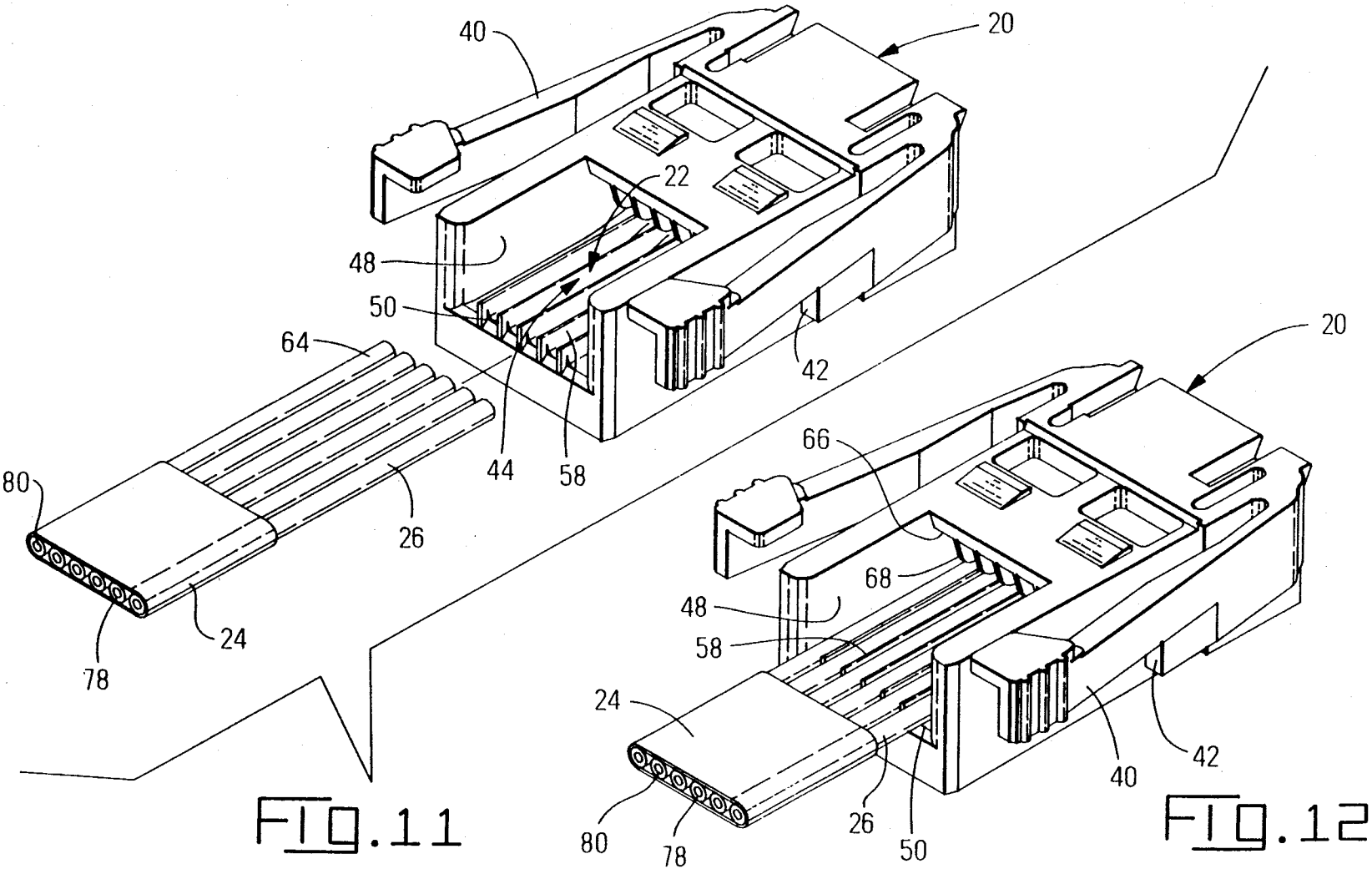
FIG. 11 shows the connector of FIG. 1 with a flat cable having conductors positioned to be received therein.
FIG. 12 shows the connector of FIG. 11 having the cable of FIG. 11 received therein with the conductors terminated to respective contacts.

As shown in FIGS. 11 and 12, the wire management system 22 of the present invention can also be used with flat cable. Employing the present invention with either shielded or unshielded cable is contemplated within the scope of the invention.

I claim:

1. A dielectric housing for an electrical connector having a plurality of insulation displacement contacts for interconnecting with conductors of a multiple conductor cable, said housing comprising:

a mating end adapted to mate with a complementary connector;

a rearward end opposite the mating end, said rearward end having a transverse external rear surface;

a cable receiving cavity for receiving the cable, said cavity being adapted to receive the conductors, said cable receiving cavity opening through the transverse rear surface and extending from the transverse rear surface to contact receiving passages, said cavity defining a rear opening at the transverse rear surface, and end wall opposite the transverse rear surface, a first side wall, a second side wall opposite the first side wall, a bottom surface between said first and second side walls, and a top wall opposite the bottom wall; and a series of contact receiving passages at the mating end corresponding to respective contacts, the passages being adapted to receive respective contacts, the passages extending through the top wall and intersecting with the cable receiving cavity;

said housing being characterized by:

rib means on the bottom wall of the cable receiving cavity, said rib means defining grooves therebetween and extending from substantially the contact receiving passages to substantially the transverse rear surface, said grooves being adapted to align the conductors for interconnection with the respective contacts.

2. A dielectric housing for an electrical connector including a plurality of insulation displacement contacts for interconnecting with conductors of a multiple conductor cable, said housing comprising:

a mating end adapted to mate with a complementary connector;

a rearward end opposite the mating end;

a cable receiving cavity for receiving the conductors, said cavity extending from the rearward end substantially to the mating end, said cavity defining a rearward opening in the rearward end, an end wall opposite the rearward opening, a first side wall, a second sidewall opposite the first side wall, a bottom wall, and a top wall opposite the bottom wall, the bottom wall having rib means thereon; and a series of contact receiving passages for receiving the contacts, said passages corresponding to the plurality of contacts and extending through the top wall and intersecting the cable receiving cavity, said series of passages extending from substantially the first sidewall to substantially the second sidewall;

the housing being characterized by:

an opening in the top wall extending from a rear surface between the series of contact receiving passages and the rearward end to the rearward end, said opening being defined by the top wall extending from the mating end to the series of contact receiving passages and therefrom to said rear surface, said opening permitting the conductors to be externally pressed between respective rib means.

* * * * *

UNITED STATES PATENT AND TRADEMARK OFFICE

CERTIFICATE OF CORRECTION

PATENT NO. : 5,147,215

DATED : September 15, 1992

INVENTOR(S) : James Pritulsky

It is certified that error appears in the above-indentified patent and that said Letters Patent is hereby corrected as shown below:

Column 5, line 26, please delete the word "and" and insert the word "an".

Signed and Sealed this

Ninth Day of November, 1993

Bruce Lehman

*Attest:*

BRUCE LEHMAN

*Attesting Officer*

*Commissioner of Patents and Trademarks*